US005334000A

United States Patent [19]

Nordlin

[11] Patent Number: 5,334,000

[45] Date of Patent: Aug. 2, 1994

[54] HOUSING ARRANGEMENT FOR COMPACT BLOWER AND VACUUM

[75] Inventor: William F. Nordlin, Rockford, Ill.

[73] Assignee: Greenlee Textron Inc., Rockford, Ill.

[21] Appl. No.: 17,031

[22] Filed: Feb. 12, 1993

[51] Int. Cl.[5] ..... F04B 35/00; A47L 9/00

[52] U.S. Cl. ..... 417/360; 417/423.2; 417/423.15; 417/423.9; 15/353

[58] Field of Search ..... 417/234, 238, 423.2, 417/423.14, 423.15, 423.9, 360, 361, 313; 15/353, 327.6, 330, 395; 254/134.4

[56] References Cited

U.S. PATENT DOCUMENTS

| | | | |
|---|---|---|---|
| 2,030,367 | 2/1936 | Grave | 15/330 |
| 2,103,154 | 12/1937 | Faber | 417/423.2 |
| 2,276,844 | 3/1942 | Holm-Hansen | 15/327.6 |
| 2,277,933 | 3/1942 | Muller | 417/423.2 |
| 2,397,980 | 4/1946 | Petri | 417/423.2 |
| 3,244,402 | 4/1966 | Ensley | 254/134.4 |
| 3,793,732 | 2/1974 | Hamrick | 254/134.4 |
| 4,142,270 | 3/1979 | Nauta | 15/353 |
| 4,248,570 | 2/1981 | Conger | 417/423.14 |
| 4,706,326 | 11/1987 | Romani | 15/330 |

FOREIGN PATENT DOCUMENTS

| | | | |
|---|---|---|---|
| 264422 | 1/1927 | United Kingdom | 417/423.2 |

*Primary Examiner*—Richard A. Bertsch
*Assistant Examiner*—Roland G. McAndrews, Jr.
*Attorney, Agent, or Firm*—Trexler, Bushnell, Giangiorgi & Blackstone, Ltd.

[57] ABSTRACT

A powered line fishing device, which can also be used as a vacuum or a blower. The device includes a thin-walled container having a bottom, side walls and a mouth. A top plate is positioned over the mouth and an intermediate plate is positioned in the thin-walled container between the mouth and the bottom and is adjustably attached to the top plate. The vacuum/blower unit is positioned between the top plate and the intermediate plate. When the assembled top plate, intermediate plate, and the associated vacuum/blower unit is inserted into the thin-walled container, the intermediate plate seals against the inside surface of the walls. The intermediate plate provides support to prevent the thin-walled container from collapsing when the device creates a vacuum. The vacuum/blower unit, retained between the top plate and intermediate plate, are retained entirely within the thin-walled container to protect the vacuum/blower unit and lower the center of gravity of the device to provide greater stability.

12 Claims, 3 Drawing Sheets

Fig. 1
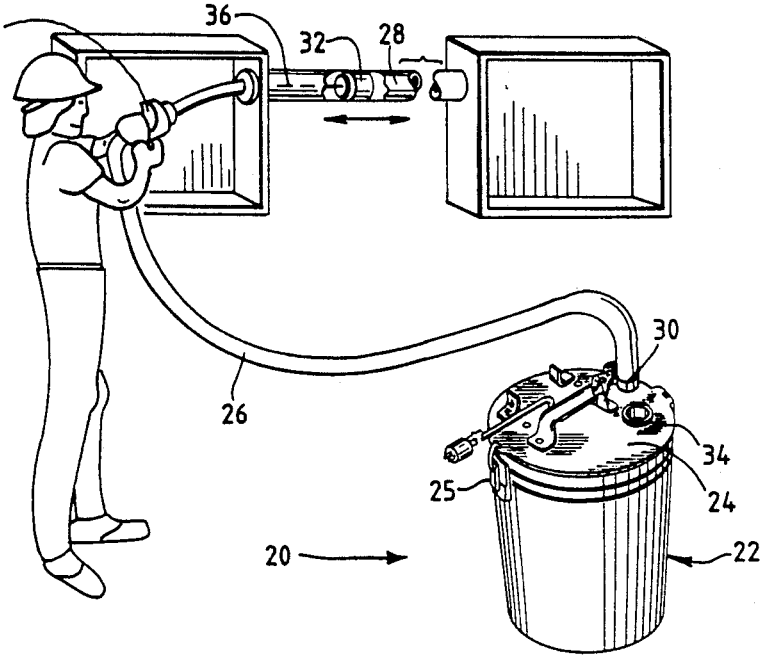
Fig. 2
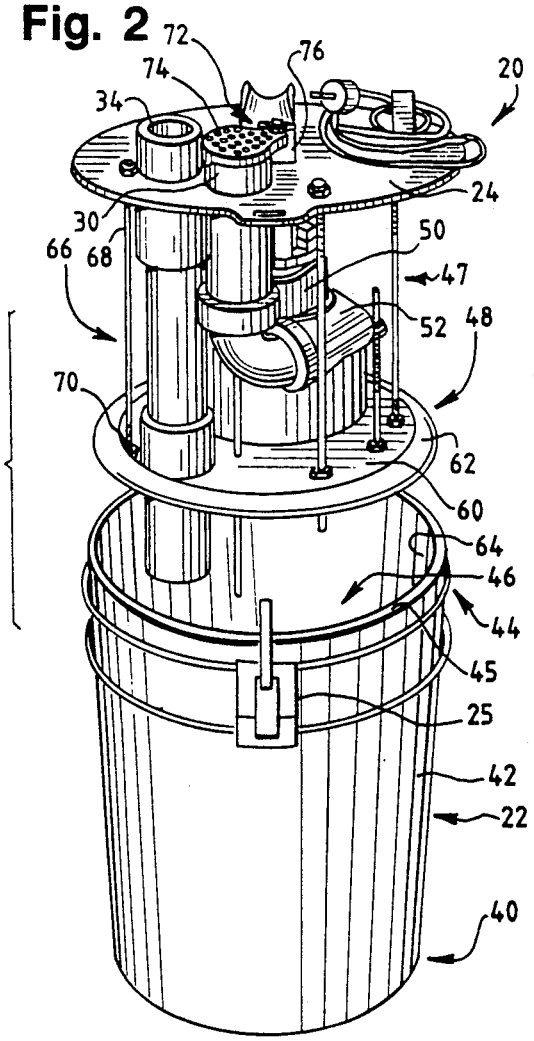
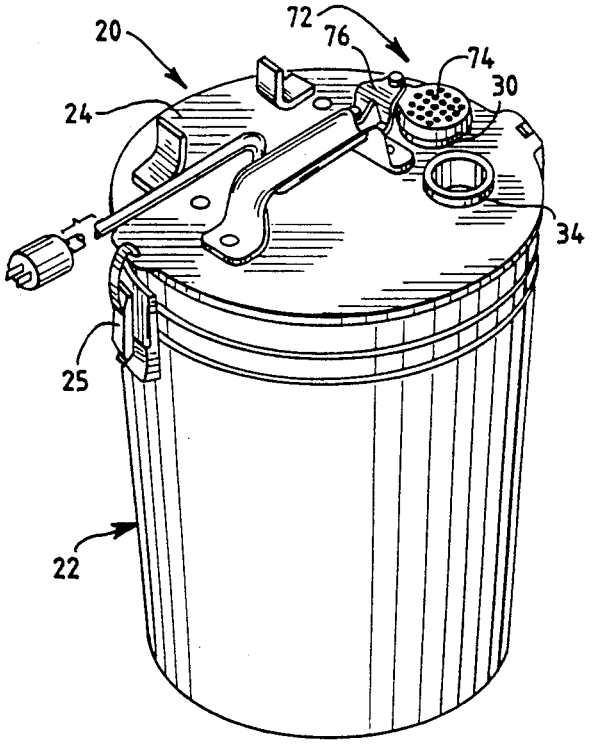
Fig. 3

Fig. 6
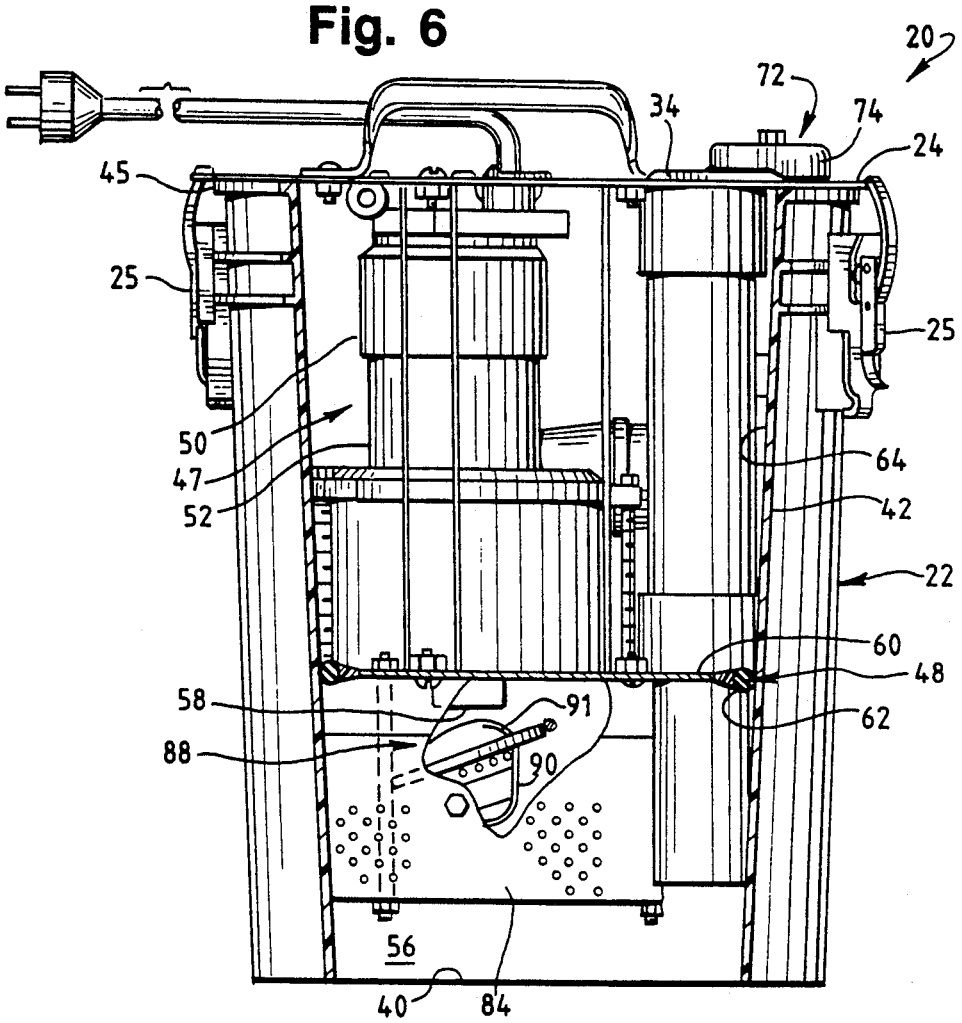
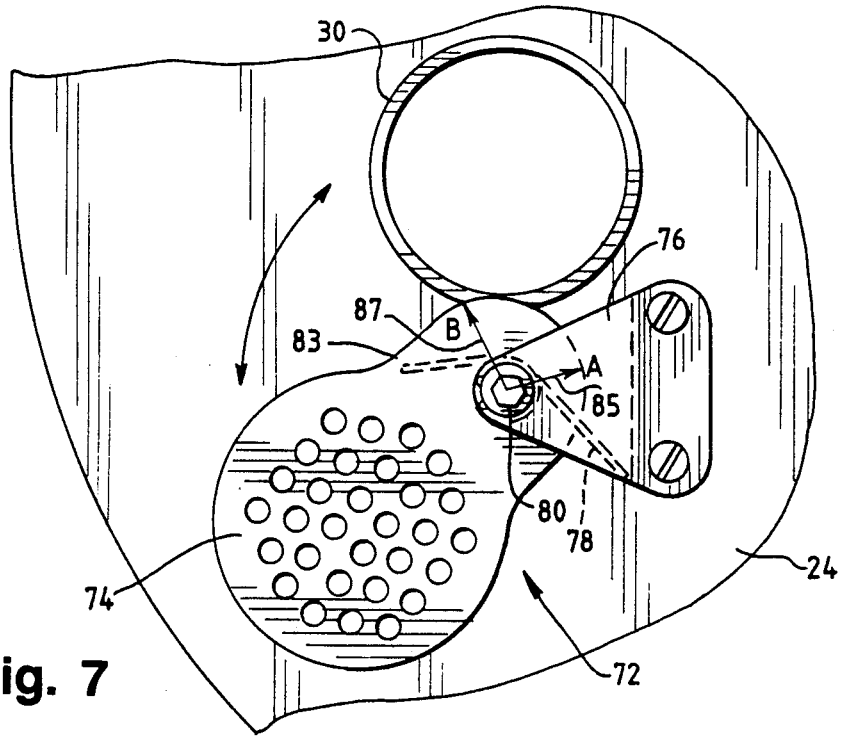
Fig. 7

HOUSING ARRANGEMENT FOR COMPACT BLOWER AND VACUUM

BACKGROUND OF THE INVENTION

The present invention relates to powered line fishing devices for creating a suctioning and blowing force for moving a line fishing piston, and attached line, through a conduit under the suctioning or blowing force. The present invention also serves as a blower or vacuum independent of fishing line through a conduit.

Conduit is used in many different ways to house and protect power and communication lines or cables. The conduit material is installed without the cables to facilitate proper installation. After the conduit is in place the cables must be threaded through the conduit. In order to thread the cables through the conduit, a pulling line must be threaded through the conduit. Once the pulling line is threaded through the conduit, the pulling line is attached to the cables for pulling the cables through the conduit.

A variety of devices are available to assist in threading a pulling line through conduit. In one situation a rigid, yet directionally flexible, "fish tape" is threaded through the conduit. The fish tape allows a degree of flexibility but is rigid enough to be pushed from a first open end of the conduit to a second open end of the conduit. This type of fish tape is useful in many situations but provide some difficulties where a number of curves or bends are encountered in the conduit. Additionally, for practical purposes such a fish tape may not be useful over extremely long distances.

For long distances or lengths of conduit which have many curves or bends, a suctioning and vacuuming device has been developed. Such devices are referred to generally as a "powered line fishing device". These devices include a piston which is insertable into the conduit and moved through the conduit by a suctioning or blowing force on the conduit. A pulling line is attached to the piston, prior to inserting the piston into the conduit, for threading the pulling line through the conduit.

The powered line fishing devices generally fall into two categories: large, expensive, high force devices; and small, inexpensive, low force devices. Each of these devices are typically specifically designed and manufactured for the a corresponding line fishing function, vis. large diameter conduit, or small diameter conduit, and therefore are somewhat specialized in design and construction.

The large devices provide a very useful function in the appropriate situation. With large diameter conduits, a large diameter piston must be used. In order to drive a large diameter piston through a large diameter conduit a rather large suctioning or blowing force is necessary to displace the volume of air in the large diameter conduit. In this application a large powered fishing device is very useful. For applications where a small diameter conduit is used or space requirements limit the use of a large power fishing device, the large device can be inconvenient or impossible to use.

For smaller diameter conduit applications and in small spaces, a smaller, less expensive, less powerful vacuum/blowing device is available. The smaller devices essentially provide a motor and impeller without a vacuum chamber. In this regard, a smaller suctioning or blowing force is developed by this device. While these devices are portable, they are limited in the degree of suction or blowing that they can create.

Each of the powered line fishing devices include a container or body, vacuum/blower unit, and a vacuum chamber in the body. The vacuum/blower unit communicates with the vacuum chamber in the container for pulling a vacuum in the chamber. The pressure differential created in the vacuum chamber tends to pull or collapse the walls of the container inwardly. As such, the walls of the container must be designed to prevent the collapse of the container when a vacuum is created in the vacuum chamber.

The vacuum/blower unit includes a motor and impeller. The motor drives the impeller to evacuate air from the chamber to create a vacuum in the vacuum chamber. Prior art devices position the vacuum/blower unit on the top of the container. The position of the vacuum/blower unit on top of the container makes the device top heavy and somewhat unstable.

Prior art devices have attempted to overcome the stability problem by positioning wheels or feet attached to the bottom of the container a distance away from the container. These "outrigged" supports, however, add weight to the device decreasing portability, add space limitations for using the device, and require further custom design and components. Additionally, since the vacuum/blower unit is mounted on the top, outside of the container, a special protective cover must be installed over this assembly to protect it from damage.

In terms of structure, the large devices require a large thick-walled container body to withstand the substantial suctioning and blowing forces created by the device. Smaller devices employ wall dimensions which are substantially thinner than the large devices, but are proportionally dimensioned to withstand the vacuum forces created by the vacuum/blower unit. Regardless of the device, prior art devices use custom designed and manufactured containers to withstand the collapsing forces of the vacuum.

As such, it would be desirable to provide a device which is more portable and less expensive than the large devices yet provides a greater vacuuming force than the currently available small devices. Additionally, it would be desirable to provide a device which is more stable than the currently available unit.

OBJECTS AND SUMMARY OF THE INVENTION

A general object of the present invention is to provide an inexpensive, portable, thin walled powered line-fishing device.

Another object of the present invention is to provide a portable thin-walled powered line fishing device which prevents the walls of the container from collapsing.

Yet another object of the present invention is to provide a portable, thin-walled powered line fishing device which houses the vacuum/blower unit interiorally of the container to increase the stability of the device and to protect the vacuum/blower unit.

Briefly, and in accordance with the foregoing, the present invention envisions a powered line fishing device, which can also be used as a vacuum or a blower. The device includes a thin-walled container having a bottom, side walls and a mouth. A top plate is positioned over the mouth for covering the thin-walled container. An intermediate plate is disposed in the thin-walled container between the mouth and the bottom.

The intermediate plate is adjustably attached to the top plate. The vacuum/blower unit is positioned between the top plate and the intermediate plate. When the assembled top plate, intermediate plate, and the associated vacuum/blower unit is inserted into the thin- walled container, the intermediate plate seals against the inside surface of the walls of the thin-walled container. A vacuum chamber is defined by the intermediate plate, the bottom of the thin-walled container, and the adjoining walls of the thin-walled container. The vacuum/-blower unit communicates with the vacuum chamber and the exterior of the thin-walled container to create a vacuum in the vacuum chamber. The intermediate plate provides support to prevent the thin-walled container from collapsing when a vacuum is created in the vacuum chamber. The vacuum/blower unit, retained between the top plate and intermediate plate, are retained entirely within the thin-walled container to protect the vacuum/blower unit and lower the center of gravity of the device to provide greater stability.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which:

FIG. 1 is a perspective view of the powered line fishing device of the present invention illustrating the use of the invention for forcing a piston through a conduit positioned between two equipment cabinets;

FIG. 2 is an enlarged, exploded, perspective view of the powered line fishing device as shown in FIG. 1;

FIG. 3 is an enlarged perspective view of the powered fishing device as shown in FIG. 1 in which a hose has been removed to provide an unobstructed view of the top plate;

FIG. 6 is partial fragmentary, cross sectional elevational view taken along line 6—6 in FIG. 4 in which filter material shown in FIG. 5 has been removed; and FIG. 7 is an enlarged detail view of a blower cover attached to the top plate in which the cover is pivoted to view a blower port extending through the top plate.

DETAILED DESCRIPTION OF THE PREFERRED EMBODIMENT

Figure 4:
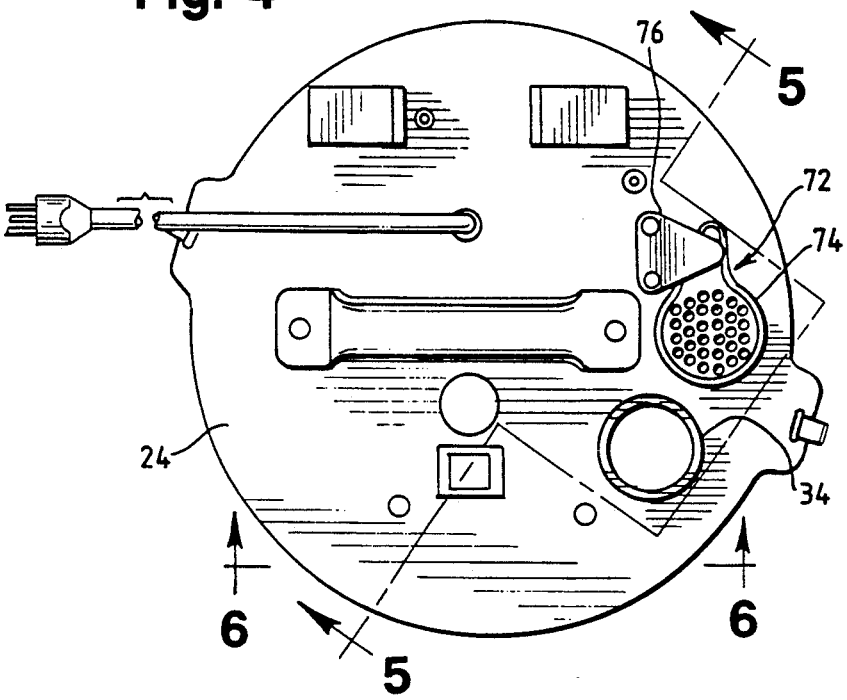
FIG. 4 is a top plan view of a top plate of the powered line fishing device.

While the invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

Referring now to the drawings, wherein like parts are designated by the same reference numeral throughout the figures, a powered line fishing device 20 in accordance with the present invention is shown in FIG. 1. The powered line fishing device 20 includes a container 22 which is covered by a top plate 24. The top plate 24 is removably attached to the container 22 by over-center clamping buckles 25 of known construction. A hose 26 is connected to the powered line fishing device 20 to direct a vacuum or blowing force in to a conduit 28. The hose 26 as shown in FIG. 1 is attached to a blower port 30 and one end of the conduit to direct the blowing force created by the powered line fishing device 20 through the conduit 28 against a piston 32 positioned in the conduit 28. The hose 26 is connectable to a vacuum port 34 to direct a vacuuming force to pull the piston 32 through the conduit 28.

As shown in FIG. 1, a user of the device 20 positions one end of the hose 26 against an end of the conduit 28 to direct a force therethrough. A line 36 is attached to the piston 32 and is metered out by a line managing device 38 coupled with the hose 36. The line managing device 38 is of known construction and design to allow the line to be fed through the hose 26 when a blowing force is applied to the piston 32. The line managing device 38 is not necessary if the suctioning force is being applied to the piston 32 such that the line 36 is fed through the end of the conduit 28 opposite to which the hose 26 is attached. Once a line 36 is fed through the conduit 28 by use of the powered line fishing device 20, a higher strength line is attached and fed through or cables such as power cables, or communication cables are attached to the line 36 and threaded through the conduit 28.

With reference to FIGS. 2-7, the container 22 is a thin-walled container having a bottom 40, side walls 42 extending from the bottom 40, and an open end 44 distal the bottom 40. A top edge 45 of the side wall 42 defines a mouth 46. As can be seen in the FIGS. 1-3, 5 and 6 the side walls 42 of the container 22 taper inwardly from the mouth 46 towards the bottom 40 defining a frustoconical shape. The advantages of the tapered walls will be discussed in further detail hereinbelow.

As shown in FIG. 2, the top plate 24 has been removed from the mouth 46 of the container 22 to reveal the vacuum/blower assembly 47 of the powered line fishing device 20. The vacuum/blower assembly 47 is retained between the top plate 24 and an intermediate plate 48 and as such is entirely retained within the container 22. The vacuum/blower assembly 47 includes a motor 50 and an impeller 52. The motor 50 and the impeller 52 are of a known construction to provide approximately 5 lbs. per square inch of vacuum. An example of an appropriate vacuum/blower assembly 47 for use in the present invention is a three-stage, single speed by-pass motor blower such as produced by AMTEK, LAMB Electric Division of Kent, Ohio.

Figure 5:
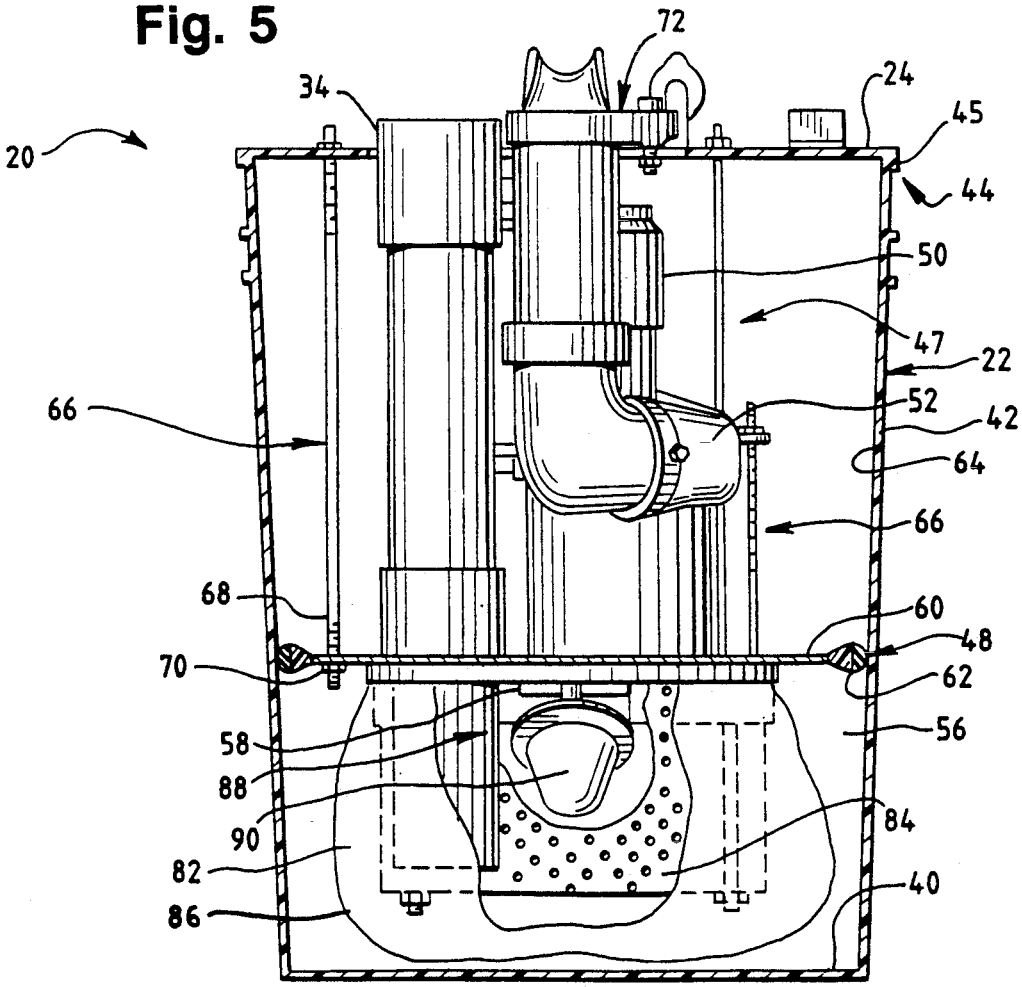
FIG. 5 is a partial fragmentary, cross sectional elevational view taken along the line 5—5 in FIG. 4.

The impeller 52 is attached to the intermediate plate 48 which is spaced a distance away from top plate 24. When the top plate 24 is mounted over the mouth 46 the vacuum/blower assembly 47 and intermediate plate 48 are completely contained within the container 22 as shown in FIGS. 5 and 6. Referring to FIGS. 5 and 6, when the intermediate plate 48 is positioned inside the container 22, a vacuum chamber 56 is defined between the bottom 40, the intermediate plate 48, and the portions of the side walls 42 therebetween.

The vacuum port 34 extends through the top plate 24 and through the intermediate plate 48 to communicate with the vacuum chamber 56. The blower port 30 communicates with the impeller 52. The impeller 52 has an intake port 58 which extends through the intermediate plate 48 to communicate with the vacuum chamber 56. When the vacuum/blower assembly 47 is operated the impeller 52 creates a vacuum in the vacuum chamber 56 by evacuating the atmosphere in the chamber 56 through the intake port 58. The air removed from the vacuum chamber 56 is exhausted from the impeller 52 through the blower port 30, thus providing the blowing force. As the vacuum in the vacuum chamber 56 increases, air is pulled from outside the device 20 into the vacuum chamber 56 through the vacuum port 34, thus creating the vacuuming force.

The construction and position of the vacuum/blower assembly 47 and the intermediate plate 48 are important to the present invention. As noted hereinabove, the container 22 is a thin-walled structure. As such, upon creation of a vacuum in the vacuum chamber 56 the walls 42 tend to be pulled inwardly under the force of the vacuum. Since the vacuum/blower assembly 47 pulls a vacuum of approximately 5 lbs. per square inch, the force on the walls 42 and the bottom 40 could be as great as 500 lbs. The intermediate plate 48 reinforces the side walls 42 to prevent inward collapse of the walls 42 when a vacuum is created in the vacuum chamber 56.

As shown in FIGS. 5 and 6, the intermediate plate 48 includes a plate body 60 and a gasket 62 positioned around the periphery of the plate body 60. The plate body 60 is formed of a suitable rigid material, such as metal, and the gasket 62 is formed of a suitable resiliently compressible material. The gasket 62 seals against an inside surface 64 of the side walls 42 to provide a seal for the vacuum chamber 56. When a vacuum is created in the vacuum chamber 56 the force of the vacuum tends to pull the intermediate plate 48 downwardly toward the bottom 40 thereby improving the effectiveness of the seal between the gasket 62 and the inside surface 64.

The positioning of the vacuum/blower assembly 47 inside of the container 22 is important such that the center of gravity of the powered line fishing device 20 is substantially lower than prior art devices thereby increasing the stability of the device 20 when in use. As noted hereinabove, prior art vacuum devices are constructed with the motor and impeller 50, 52 on top of the top plate 24 outside of the container 22. This results in a rather unstable structure since the motor and impeller 50, 52 can make up a large proportion of the total weight of the device.

The present invention, in contrast, by positioning the motor and impeller 50, 52 inside of the container 22, protects the motor and impeller 50,52 against direct impact and other detrimental environmental effects. As such, no additional specialized housing is required to be placed over the motor and impeller unit 50, 52 as in prior art devices.

As shown in FIG. 2, the intermediate plate 48 is adjustably attached to the top plate 24 by an adjustment assembly 66. The adjustment assembly 66 includes threaded rods 68 which engage threaded nuts 70 attached to the intermediate plate 48. The ability to adjust the position of the intermediate plate 48 relative to the top plate 24 is useful to accommodate variations in container 22 dimensions to provide a sufficient seal between the intermediate plate 48 and the vacuum chamber 56.

As mentioned hereinabove, the container 22 has tapered side walls 42 forming a frustoconical shape. The frustoconical shape facilitates ease of removal when the top plate 24 is disengaged from the mouth 46 such that the increasing diameter of the container 22 allows easier disengagement of the gasket 62 from the inside surface 64 of the container 22.

The powered line fishing device 20 also includes a blower port cover 72 which covers the blower port 30 and also clamps a hose 26 disposed in communication with blower port 30. The blower port cover 72 includes a foraminous cover portion 74 with a mounting bracket 76 biasing means 78, and a pivot shaft 80. The mounting bracket 76 is attached to the top plate 24 with the pivot shaft 80 extending between the bracket 76 and the top plate 24. The biasing means or spring 78 engages the foraminous cover portion 74 to bias the foramimous cover portion 74 over the blower port 30.

When the blower port is not in use the foraminous cover portion 74 is biased over the blower port 30 to prevent debris from entering the blower port 30. For example, if the debris were to enter the blower port 30 when the vacuum/blower assembly 47 is turned off, such debris could be blown out of the port 30 when the device is turned on creating a possible hazard. Additionally, it is desirable to prevent open access to the impeller 52 to protect users as well as the impeller 52.

As more clearly shown in FIG. 7, the foraminous cover 74 is attached to the bracket 76 to create a camming action against a hose when the hose is inserted into the blower port 30. The camming action holds the hose in the blower port 30 against the positive air pressure force created in the blower port 30. The camping action is a result of the pivotable, off-center mounting of an arm portion 83 of the cover 74 in the bracket 76. The off-center mounting is shown by the radial dimension 85 measured between the pivot shaft 80 and the perimeter of the arm portion 83 at point A being smaller than the radial dimension 87 measured between the pivot shaft 80 and point B on the perimeter of the arm portion 83. The pivot shaft 80 extends through the bracket 76 and arm portion 83 and provides a stationary pivot point for the off-center pivoting of the cover 74.

When a hose 26 is to be connected to the blower port 30, the foraminous cover 74 is moved out of engagement from the blower port 30 and the hose 26 is inserted into the blower port 30. When the foraminous cover 74 is released, the spring 78 biases the foraminous cover 74 against a portion of the hose 26 projecting from the blower port 30. As such, the cover 74 acts to retain the hose 26 in the blower port 30 to prevent disengagement of the hose 26 from the blower port 30. To remove the hose 26, the foraminous cover 74 is moved so that it is no longer engages or abuts the hose 26 such that the hose 26 may be disengaged from the blower port 30.

As more clearly shown in FIGS. 5 and 6, the present invention includes a filter assembly 82. The filter assembly 82 as shown in FIG. 5 includes a foraminous housing 84 positioned over the intake port 58 of the impeller 52 and a filter material 86 which is attached over the foraminous housing 84. The foraminous housing 84 helps to support the filter material 86 a distance away from the intake port 58 to prevent the filter material 86 from being sucked into the intake port 58 when the device is operated.

The filter assembly 82 is important to prevent damage to the device 20 such that debris may be suctioned through the conduit and through the hose into the vacuum chamber 56. Such debris may include metal shavings from boring holes in metal cabinets to which the conduit is attached, lubricants used to facilitate moving the piston through the conduit, as well as general debris both solid and liquid which are deposited in the vacuum chamber 56 when the device 20 is used as a vacuum unit.

A liquid float valve 88 is provided to sense when a predetermined level of liquid has accumulated in the vacuum chamber 56. The liquid float valve 88 includes a buoyant float body 90 hingedly retained in the foraminous housing 84 which is aligned with the intake port 58. As the level of liquid in the vacuum chamber 56 increases the buoyant float body 90 rides on the top of the liquid. At a predetermined level a top portion 91 of the float body cooperatively mates with the intake port 58 to block the intake port 58 and effectively terminate operation of the vacuum/blower assembly 47.

In use, the power fishing device 20 includes the thin-walled container 22, the vacuum/blower assembly 47, the top plate 24, and the intermediate plate 48. When the vacuum/blower assembly 47 is inserted in to the container 22 the gasket 62 of the intermediate plate 48 forms a seal against the inside surface 64 of the side walls 42. When a vacuum is created by the vacuum/-blower assembly 47 in the vacuum chamber 56, the rigid plate body 60 prevents the side walls 42 from collapsing inwardly under the force of the vacuum.

Since the vacuum assembly is completely retained within the container 22 the device 20 is highly stable and not prone to tipping. Additionally, the motor and impeller 50, 52 are protected since they are retained completely within the container 22.

The blower cover 72 protects the blower port 30 against debris being placed therein and users from debris being expelled therefrom. Additionally, the blower cover 72 biasedly retains a hose in engagement with the blower port 30, using a camming action, against the blowing forces when the hose is inserted therein.

When operated, a hose 26 is attached to either one of the blower or vacuum port 30, 34 to provide a force to drive a piston 32 through a conduit 38. The motor 50 drives the impeller 52 to create a vacuum in the vacuum chamber 56. The vacuum sucks air through the vacuum port 34 into the vacuum chamber 56 and expels the air through the intake port 58 of the impeller 52 and out through the blower port 30.

Air entering the vacuum chamber 56 is filtered by the filter assembly 82 such that the air must pass through the filter material 86 and the foraminous housing 84 before entering the intake port 58. Debris carried in the air is filtered by the filter material and deposited in the vacuum chamber 56. If liquids are vacuum accumulated in the vacuum chamber 56, the liquid float valve 88 provides a fail safe to prevent liquid accumulation in the vacuum chamber 56 from exceeding a predetermined level. As such, at the float body 90 rises on the accumulating liquids the top portion 91 will block the intake port 58 when the float 90 rises to a predetermined level.

When material must be removed from the vacuum chamber 56, the clamp buckles 25 attached to the outside surface of the container 22 are disengaged from the plate 24 thereby allowing the top plate 24 to be removed from the mouth 46. As the vacuum assembly 47 is extracted from the inside of the container 22, the seal formed between the gasket 62 and the inside surface 64 of the container 22 is broken. The tapered walls 42 of the container 22 further facilitate easy removal of the vacuum assembly 47 from the container 22.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A device for creating a suctioning and blowing force, said device comprising:

a thin walled container having a bottom end and an open end;

a top cover positionable on said container to cover said open end;

an intermediate plate disposed in said container, said intermediate plate being spaced between said bottom end and said top plate and abutting an inside surface of said container for forming a seal with said inside surface of said container and for reinforcing said thin walled container against vacuum forces;

a vacuum chamber being defined between said container and said intermediate plate said vacuum chamber being spaced away from said top plate;

vacuum producing means substantially retained within said container between said top plate and said intermediate plate and communicating with said vacuum chamber;

a vacuum port communicating with said vacuum chamber, said vacuum port extending through said top plate and said intermediate plate; and a blower port communicating with said vacuum means, said blower port extending through said top plate.

2. A device as recited in claim 1, wherein said container is frustoconically shaped with said bottom having a smaller diameter than said open end, said open end being positioned above said bottom.

3. A device as recited in claim 1, further comprising:

a filter device being operatively associated with said vacuum port for filtering atmosphere flowing through said vacuum port and into said vacuum chamber to prevent the introduction of debris into said vacuum means.

4. A device as recited in claim 1, wherein said device is capable of vacuum collecting liquids, said device further comprising:

a liquid float valve disposed in said vacuum chamber for blocking said intake port on said vacuum means to prevent continued vacuum accumulation of liquids.

5. A device as recited in claim 1, wherein said container is formed with walls which taper inwardly from said open end towards said bottom end, said intermediate plate being adjustably attached to said top plate for positioning said intermediate plate in said container for forming a seal between said intermediate plate and an inside surface of said container.

6. A device for creating a suctioning and blowing force, said device comprising:

a thin-walled container having a bottom, a side wall joined with said bottom, and a mouth defined along an edge of said side wall distal said bottom;

a removable vacuum assembly operatively associated with said container, a top plate of said vacuum assembly operatively associated with said container to cover said mouth, an intermediate plate of said vacuum assembly depending from said top plate, said intermediate plate being spaced away from said top plate, means for producing a vacuum operatively associated with said vacuum assembly positioned between said top plate and said intermediate plate, a vacuum port extending through said top and intermediate plates communicating with said container, a blower port communicating with said vacuum means for expelling atmosphere from said container; and a vacuum chamber being defined by said bottom, said intermediate plate and a portion of said side wall between said bottom and said intermediate plate when said removable vacuum assembly is disposed in said container.

7. A device as recited in claim 6, further comprising a filter device being operatively associated with said vacuum port for filtering atmosphere flowing through said vacuum port and into said vacuum chamber to prevent the introduction of debris into said vacuum means.

8. A device as recited in claim 6, further comprising means for covering said blower port and clamping a hose disposed in said blower port, said covering and clamping means being selectively disposed relative to said blower port, blower port cover selectively displaceable between covering and clamping positions relative to said blower port for preventing debris from becoming displaced into said blower port and retaining a hose in communication with said blower port.

9. A device as recited in claim 6 further including said intermediate plate being adjustably attached to said top plate for positioning said intermediate plate in said container.

10. A device as recited in claim 9 further comprising adjustable rods attached to said top plate and said intermediate plate attached to said top plate and said intermediate plate for adjusting the distance between said top plate and said intermediate plate.

11. A device as recited in claim 9, further comprising a gasket retained on a perimeter of said intermediate plate for forming a seal between said intermediate plate and a portion of an inside surface of a side wall of said container.

12. A vacuum producing device for creating a suctioning and blowing force, said device comprising:

a container having a bottom end, an open end distal said bottom end, and a mouth defined along an edge of said open end;

a top plate disposed on said container to cover said mouth;

an intermediate plate disposed in said container spaced between said bottom end and said top plate, said intermediate plate forming a seal with an inside surface of said container;

a vacuum chamber defined by a portion of said container partitioned by said intermediate plate;

means for producing a vacuum disposed in said container substantially between said intermediate plate and said top plate;

a vacuum port in communication with said vacuum chamber;

a blower port in communication with said vacuum producing means; and means for covering said blower port and clamping a hose disposed in said blower port, said covering and clamping means being selectively disposable relative to said blower port, blower port said cover selectively displaceable between covering and clamping positions relative to said blower port for preventing debris from becoming displaced into said blower port and retaining a hose in communication with said blower port.

* * * * *